US005971185A

United States Patent [19]

Schütz

[11] Patent Number: 5,971,185

[45] Date of Patent: Oct. 26, 1999

[54] TRANSPORT AND STORAGE CONTAINER FOR LIQUIDS

[75] Inventor: Udo Schütz, Selters-Westerwald, Germany

[73] Assignee: Protechna S.A., Fribourg, Switzerland

[21] Appl. No.: 09/081,874

[22] Filed: May 20, 1998

[30] Foreign Application Priority Data

May 20, 1997 [DE] Germany ..... 197 20 931

[51] Int. Cl.[6] ..... B65D 90/04

[52] U.S. Cl. ..... 220/1.6; 220/23.9; 220/592.21; 220/9.4; 220/495.06

[58] Field of Search ..... 220/1.6, 23.9, 220/592.21, 9.4, 495.06

[56] References Cited

U.S. PATENT DOCUMENTS

| | | | |
|---|---|---|---|
| 3,410,443 | 11/1968 | Hofmann | 220/592.21 |
| 3,603,107 | 9/1971 | Elliott | 220/592.21 |
| 4,919,366 | 4/1990 | Cormier | 220/592.21 |
| 5,658,679 | 8/1997 | Schutz | 220/1.6 |
| 5,680,955 | 10/1997 | Schutz | 220/1.6 |

FOREIGN PATENT DOCUMENTS

| | | |
|---|---|---|
| 195 11 723 C1 | 8/1996 | Germany . |

*Primary Examiner*—Joseph M. Moy
*Attorney, Agent, or Firm*—Friedrich Kueffner

[57] ABSTRACT

A transport and storage container for liquids with a pallet-like underframe, an exchangeable inner container of synthetic material with four side walls, a bottom wall and a top wall, a closeable inlet opening at the top and a lower outlet opening with a draining device, and with an outer casing surrounding the inner container, wherein the outer casing is formed of vertically and horizontally extending grate rods of metal. The transport and storage container is provided with a support insert with four side walls arranged between the inner container and the outer casing, wherein the support insert is of an electrically conductive material.

17 Claims, 3 Drawing Sheets

TRANSPORT AND STORAGE CONTAINER FOR LIQUIDS

BACKGROUND OF THE INVENTION

1. Field of the Invention

The present invention relates to transport and storage containers for liquids with a pallet-like underframe, an exchangeable inner container of synthetic material with four side walls, a bottom wall and a top wall, a closeable inlet opening at the top and a lower outlet opening with a draining device, and with an outer casing surrounding the inner container, wherein the outer casing is formed of vertically and horizontally extending grate rods of metal.

2. Description of the Related Art

When liquid containers of this type known from DE 195 11 723 C1 are filled and emptied and when liquids are stirred in this type of containers, for example, for mixing purposes, electric charges may occur at the container surfaces as a result of liquid friction. The principal danger of electrostatic charging is the fact that ignition sources come into contact with explodable mixtures of gases and vapors.

Because the electrostatic charging capability of the inner container of synthetic material, transport and storage containers of the aforementioned type cannot be used in explosion-endangered rooms and cannot be filled with explosive liquids.

Another disadvantage of the aforementioned type of pallet container is the fact that they are insufficiently fire resistant in the case of fire, because of the outer casing of vertical and horizontal grate rods. The insufficient fire resistance of the known container results in higher storage costs as compared to fire resistant containers, wherein the higher costs are due to increased insurance premiums.

SUMMARY OF THE INVENTION

The invention is based on the object of improving the construction of the aforementioned type of transport and storage container for liquids in such a way that an electrostatic charging of the inner container of synthetic material is avoided when filling the containers with liquids and when draining the liquids from the containers, and to achieve a higher fire resistance of the container.

In accordance with the invention, this object is met by a transport and storage container for liquids provided with a support insert with four side walls arranged between the inner container and the outer casing, wherein the support insert is of an electrically conductive material.

In a transport and storage container for liquids which is equipped with an inner container of synthetic material, an outer casing formed by vertical and horizontal grate rods of metal, and a pallet-like underframe, the invention is based on arranging between the inner container of synthetic material and the outer casing a support insert with four side walls of an electrically conductive material, preferably metal, so that electric charges which may be formed on the surfaces of the inner container of synthetic material when filling and emptying the transport and storage container can be discharged to the ground through the support insert, the outer casing and the pallet-like underframe which also is composed of an electrically conductive material.

The electric grounding of the inner container of synthetic material makes it possible to use the transport and storage container as a dangerous material container for combustible liquids, such as paints, varnishes and solvents, with a flash point of<35° C., and the use of the container in work rooms in which an explosive atmosphere may be formed by gases, vapors or mists.

The support insert contributes to an increase of the strength of the inner container of synthetic material, so that the manufacturing costs of the transport container can be lowered by a decrease of the number of grate rods of the outer casing and the required intersecting joint weld connections of the grate rods. Furthermore, an improved fire resistance of the container is achieved by the support insert.

Finally, the support insert provides an effective protection for the inner container of synthetic material against outer impact or shock loads and a light protection, particularly, a protection against UV radiation for light-sensitive liquid filling materials.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
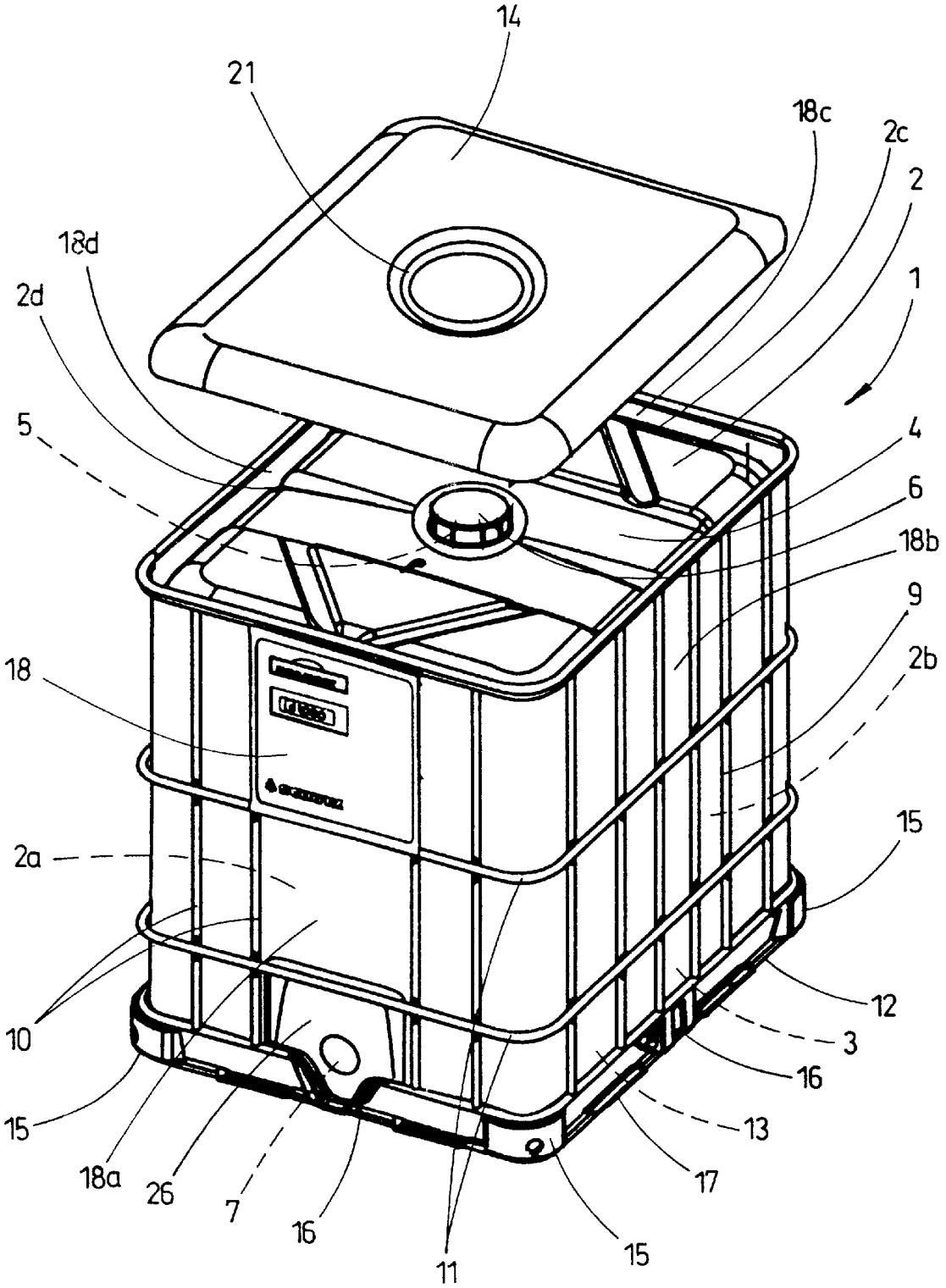
FIG. 1 is a perspective view of a transport and storage container.
Figures 2, 3:
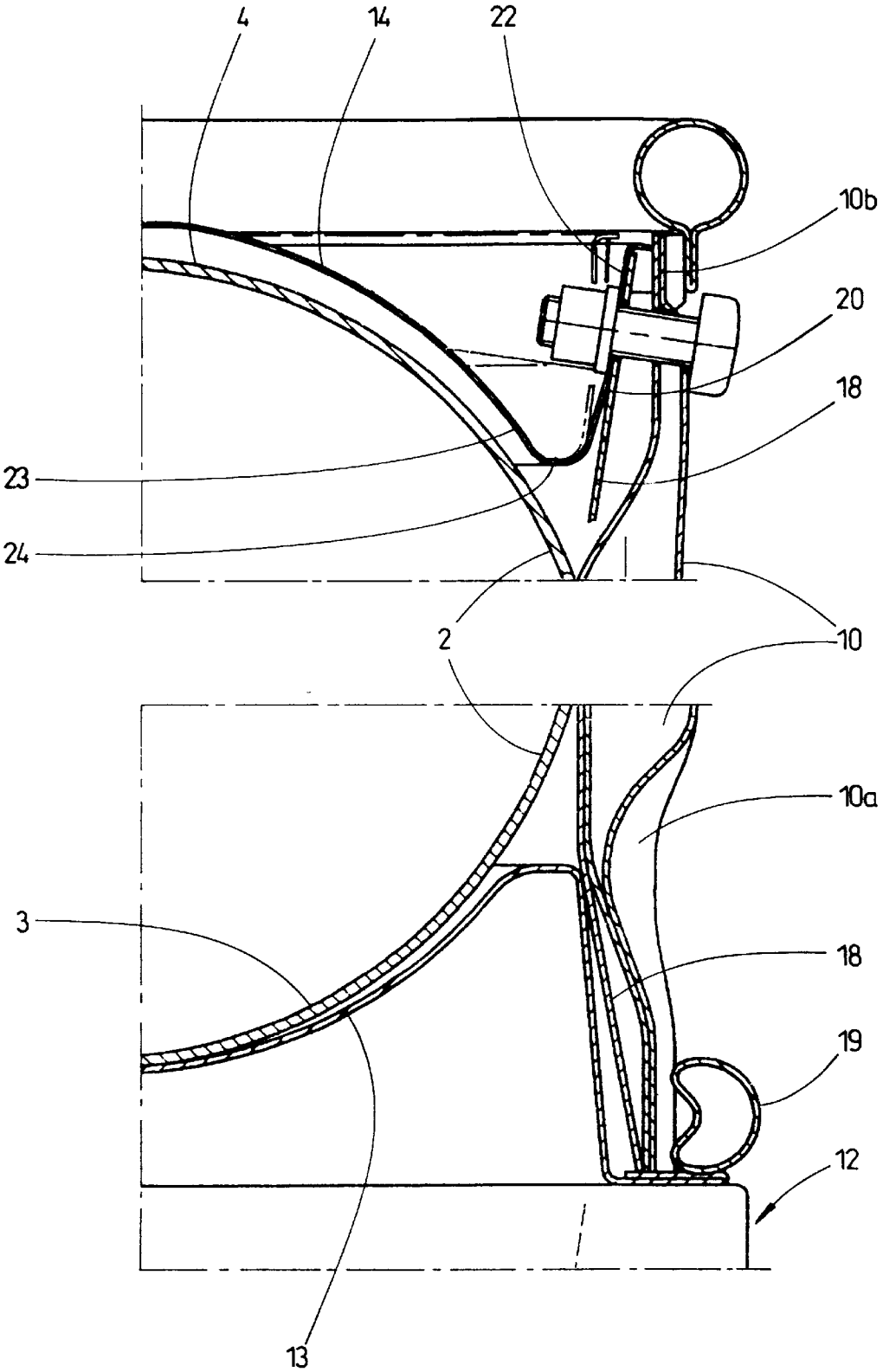
FIG. 2 is an enlarged partial sectional view of the bottom area.
FIG. 3 is an enlarged partial sectional view of the cover area of the container.
Figure 4:
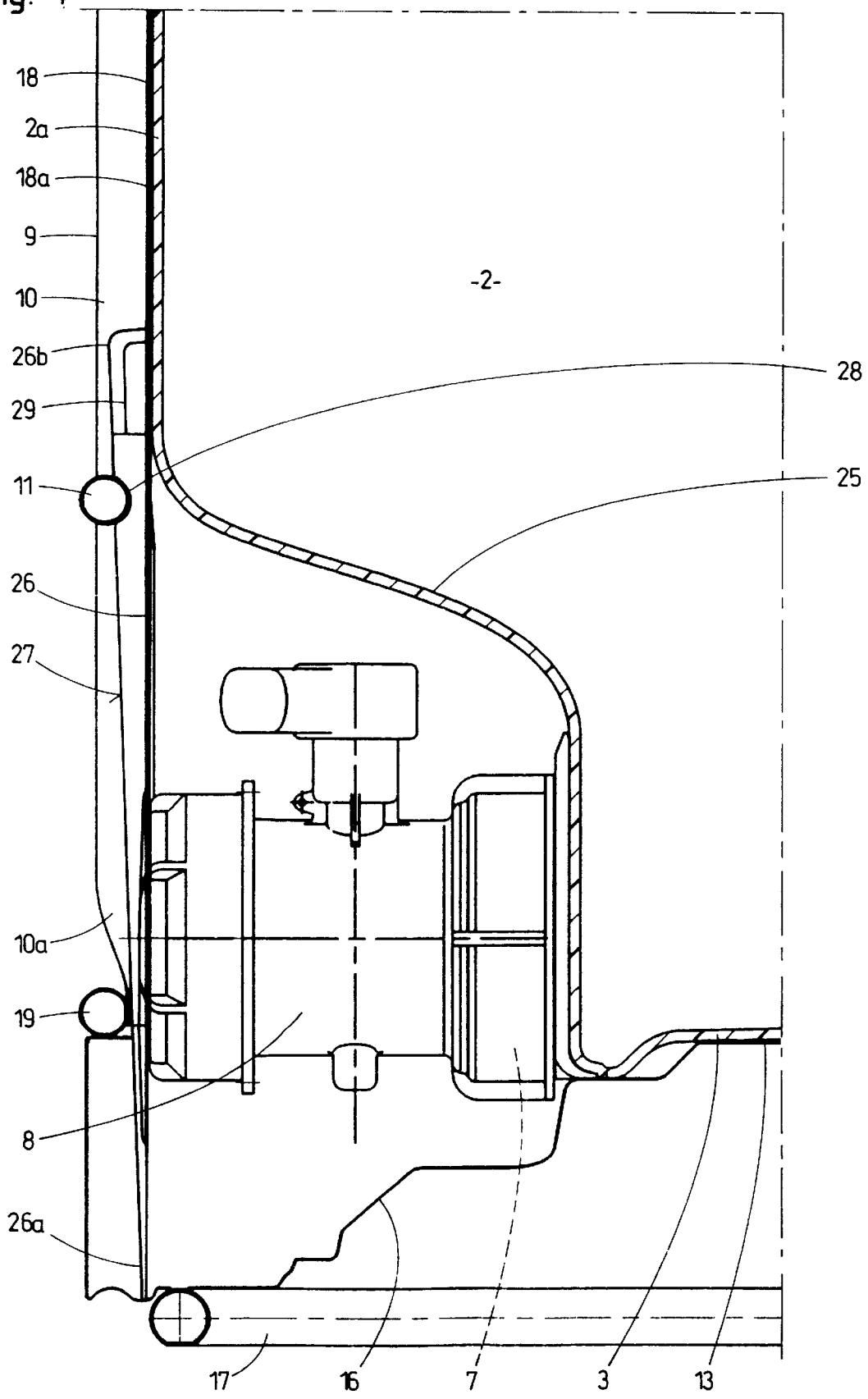
FIG. 4 is an enlarged partial sectional view of the draining fitting of the container protected by a slide mender.

The transport and storage container 1 for liquids which can be used as a disposable container and a reusable container includes as principal structural components a replaceable parallelepiped inner container 2 of polyethylene with four side walls 2*a*–2*d*, a bottom wall 3 constructed as a draining bottom, an upper wall 4 with an inlet connection 5 and an outlet connection 7 with a drain cock 8, an outer casing 9 of intersecting vertical and horizontal grate rods 10, 11 of metal, a pallet-like underframe 12 with a bottom basin of sheet metal for receiving with frictional engagement the inner container 2 of synthetic material, and a cover 14 of sheet metal for protecting the inner container 2.

The bottom basin 13 rests with a certain bottom clearance on corner and middle legs 15, 16 and a bottom frame 17 or skids, so that the gripping arms of a transport device, for example, a fork lift, can be moved from four sides under the bottom basin 13 for transporting the transport and storage container 1. The legs 15, 16 and the bottom frame 17 or the skids are of metal or an electrically conductive synthetic material, for example, polyethylene with a conductive soot portion. The pallet-like underframe 12 of the transport and storage container 1 has length and width dimensions conforming to European standards.

A support insert 18 with four side walls 18*a*–18*d* is arranged between the inner container 4 of synthetic material and the outer casing 9 of the transport container 1. The single-piece support insert 18 is manufactured by stretching a pipe element of metal on a stretching press.

In a modified embodiment, the support insert 18 is composed of two U-shaped elements of metal.

It is also possible to manufacture the support insert 18 of electrically conductive plates of synthetic material.

The side walls 18*a*–18*d* of the support insert 18 are clamped between the bottom basin 13 and the lower inwardly bent ends 10*a* of the vertical grate rods 10 of the outer casing 9.

It is also possible to screw the side walls 18*a*–18*d* of the support insert 18 to the lower ends 10*a* of the vertical grate rods 10 and/or to the lower grate rod 19 of the outer casing 9.

The slightly outwardly angled upper rim 20 of the support insert 18 facilitates insertion of the inner container 2 into the support insert and prevents damage of the inner container when it is inserted.

Electric charges which may possibly occur when filling the transport and storage container with a liquid and when removing liquid from the container 1 due to liquid friction at the surfaces of the inner container 2 of synthetic material are discharged into the ground through the support insert 18, the outer casing 9, the bottom basin 13, the corner and middle legs 15, 18 and the bottom frame 17.

The cover 14 of the transport and storage container 1 has a central entry opening 21 to the inlet connection 2 of the inner container 2 which can be closed by the screw cap 6 and a groove 23 with water discharge holes 24 extending circumferentially on the inner side of the cover rim 22.

The cover 14 placed with its rim 22 in the upper rim 20 of the support insert 18 is screwed together with the support insert 18 to the upper ends 10*b* of the vertical grate rods 10 of the outer casing 9.

The outlet connection 7 with the drain cock 8, which is arranged in an indented portion 25 of the front wall 2*a* of the inner container 2 in the area of the lower wall 3, and the discharge area underneath the drain cock 8 formed by the middle leg 16 can be covered by a slide member 26 of metal which is placed between the front wall 18*a* of the support insert 18 which is cut out in the lower portion, the lower horizontal grate rod 19 and the horizontal grate rod 11 above the grate rod 19 of the outer casing 9. The slide member 26 has a guide surface 27 which is slightly outwardly inclined from the lower border area 26*a* and has in the upper portion thereof a groove 28 for engaging in the second to lowermost horizontal grate rod 11 of the outer casing 9 in the closed position of the slide member 26. For removing liquid from the container 1, the slide member 26, which has a gripping indentation 29 in the upper border area 26*b*, is pulled up and is engaged by means of the groove 28 on a horizontal grate rod 11.

In case of fire, the inner container 2 of synthetic material is protected against the external influence of fire by the bottom basin 13, the support insert 18 with the slide member 26 and the cover 14, wherein elements 13, 18, 14 are made of metal. The inner container 2 is cooled against the heat influence of a fire by water emerging from a fire fighting plant which impinges on the cover 14 of the container 1 and flows through the water discharge holes 24 of the circumferential groove 23 of the cover 14 between the side walls 2*a*–2*d* of the inner container 2 and the side walls 18*a*–18*d* of the support insert 18 and further through the water discharge holes in the bottom basin 13 to the ground.

In an embodiment with reduced fire resistance, the transport and storage container may be equipped with a protective flap of metal or synthetic material for the outlet connection and the drain cock hinged to the second to lowermost horizontal grate rod of the outer casing, and the support insert may have observation holes.

The support insert 18 and the pallet-like underframe 12 of the transport and storage container 1 are preferably made of metal. In a container 1 with reduced fire resistance, the support insert and the underframe may be manufactured of an electrically conductive synthetic material, for example, polyethylene with a portion of conductive soot.

While specific embodiments of the invention have been shown and described in detail to illustrate the inventive principles, it will be understood that the invention may be embodied otherwise without departing from such principles.

I claim:

1. A transport and storage container for liquids, comprising a pallet-like underframe, an exchangeable inner container mounted on the underframe, the inner container comprising four side walls, a bottom wall and a top wall, an upper closeable inlet opening and a lower outlet opening with a draining device, an outer casing surrounding the inner container, the outer casing being comprised of vertical and horizontal grate rods of metal, further comprising a support insert having four side walls being mounted between the four side walls of the inner container and the outer casing, wherein the support insert is of an electrically conductive material.

2. The container according to claim 1, wherein the support insert is comprised of a single element.

3. The container according to claim 2, wherein the support insert is comprised of multiple elements.

4. The container according to claim 2, wherein the support insert is comprised of a pipe element of metal stretched on a stretching press.

5. The container according to claim 3, wherein the support insert is comprised of two U-shaped elements which are connected to each other.

6. The container according to claims 1, wherein the underframe comprises a bottom basin of metal or synthetic material for receiving the inner container, and wherein the side walls of the support insert are clamped between the bottom basin and the grate rods of the outer casing.

7. The container according to claim 1, wherein the vertical grate rods of the outer casing have lower ends, and the outer casing has a lowermost horizontal grate rod, and wherein the side walls of the support insert are screwed at least one of to the lower ends of the vertical grate rods and the lowermost horizontal grate rod of the outer casing.

8. The container according to claim 1, wherein the vertical grate rods of the outer casing have upper ends, wherein the side walls of the support insert have a slightly outwardly angled upper rim, and wherein the upper rim is screwed to the upper ends of the vertical grate rods of the outer casing.

9. The container according to claims 1, further comprising a cover of metal or synthetic material, the cover having a central entry opening for providing access to an inlet connection of the inner container, further comprising a screw cap for closing the inlet connection, wherein the cover has a rim having an inner side, and wherein a circumferential groove with water drainage holes is provided at the inner side of the rim of the cover.

10. The container according to claim 9, wherein the rim of the cover is inserted into the upper rim of the support insert, and wherein the cover is screwed together with the support insert to the upper ends of the vertical grate rods of the outer casing.

11. The container according to claim 1, further comprising a slide member of metal or synthetic material for covering an outlet connection with a drain cock mounted in an indentation in an area of the bottom wall of the inner container.

12. The container according to claim 11, wherein the slide member is mounted between the grate rods of the outer casing and the support insert, the slide member having a guide surface slightly outwardly inclined from the bottom wall, the guide surface having in an upward portion thereof a groove configured to be engaged by a horizontal grate rod of the outer casing, and wherein the guide surface has a gripping indentation in the upper portion thereof.

13. The container according to claim 11, further comprising a protective flap of metal or synthetic material for the outlet connection, the protective flap being hinged to a second to lowermost horizontal grate rod of the outer casing.

14. The container according to claim 1, wherein the support insert has observation holes.

15. The container according to claim 1, wherein the support insert and the underframe are of metal.

16. The container according to claim 1, wherein the support insert and the underframe are of an electrically conductive synthetic material.

17. The container according to claim 16, wherein the synthetic material is polyethylene with a portion of conductive soot.

* * * * *